US008801546B2

(12) United States Patent
Roark et al.

(10) Patent No.: US 8,801,546 B2
(45) Date of Patent: Aug. 12, 2014

(54) DISTANCE TO GOLF CUP MEASURING ACCESSORY

(76) Inventors: Dave Roark, Thousand Oaks, CA (US); James A. Rogers, West Hills, CA (US)

( * ) Notice: Subject to any disclaimer, the term of this patent is extended or adjusted under 35 U.S.C. 154(b) by 152 days.

(21) Appl. No.: 13/416,760

(22) Filed: Mar. 9, 2012

(65) Prior Publication Data

US 2013/0150172 A1 Jun. 13, 2013

Related U.S. Application Data

(60) Provisional application No. 61/568,580, filed on Dec. 8, 2011.

(51) Int. Cl.
*A63B 57/00* (2006.01)
*G01B 3/10* (2006.01)

(52) U.S. Cl.
USPC ..... 473/407; 33/759

(58) Field of Classification Search
USPC ..... 473/407, 173–176; 33/755, 759, 760; 81/321, 92, 120
See application file for complete search history.

(56) References Cited

U.S. PATENT DOCUMENTS

| | | | | | |
|---|---|---|---|---|---|
| 1,382,832 | A * | 6/1921 | Hill | 81/321 |
| 1,544,807 | A * | 7/1925 | Childs | 81/90.4 |
| 1,658,075 | A * | 2/1928 | Butt | 81/90.9 |
| 1,690,007 | A * | 10/1928 | Greve | 81/472 |
| 1,924,393 | A * | 8/1933 | Beery | 81/90.1 |
| 2,041,119 | A * | 5/1936 | Duganne | 473/176 |
| 3,521,509 | A * | 7/1970 | Rountree et al. | 81/57.15 |
| 3,604,711 | A * | 9/1971 | Hansburg | 473/257 |
| 3,774,481 | A * | 11/1973 | Goodman | 81/57.13 |
| 3,834,030 | A * | 9/1974 | Hanson | 33/759 |
| 4,273,329 | A * | 6/1981 | Trigg et al. | 473/407 |
| 4,532,712 | A * | 8/1985 | Vistain | 33/613 |
| 4,854,579 | A * | 8/1989 | Baxter | 473/407 |
| 4,880,232 | A * | 11/1989 | Lang | 473/176 |
| D305,306 | S * | 1/1990 | Casiello | D10/70 |
| 4,960,278 | A * | 10/1990 | Hainey | 473/407 |
| D377,611 | S * | 1/1997 | Miklas | D10/70 |
| 6,102,817 | A * | 8/2000 | Boswell | 473/407 |
| 6,336,381 | B2 * | 1/2002 | McDonnell | 81/57.33 |
| D569,746 | S * | 5/2008 | Scott | D10/70 |
| 7,632,033 | B2 * | 12/2009 | Wales | 401/37 |
| 7,708,658 | B2 * | 5/2010 | McInerney | 473/407 |
| 7,815,530 | B2 * | 10/2010 | Cannata | 473/407 |
| 8,317,633 | B2 * | 11/2012 | Maclean | 473/177 |
| 2003/0177870 | A1 * | 9/2003 | Neves et al. | 81/57.2 |
| 2011/0136591 | A1 * | 6/2011 | Podlogar | 473/407 |

* cited by examiner

*Primary Examiner* — Steven Wong
(74) *Attorney, Agent, or Firm* — Kenneth L. Green

(57) ABSTRACT

A tape measure is attached to an accessory attached to a flag pole residing in a golf course hole. The accessory includes a mouth openable to engage the flag pole. Once the mouth is closed, the pole resides in a throat surrounded by a plurality of rollers residing co-axial with the pole. The rollers allow the accessory to freely rotate on the flag pole, but include a non-slip outer surface to prevent the accessory from sliding on the pole. Tape is drawn from the tape measure attached to a measuring tape attachment feature to measure the distance to a golf ball, and the accessory freely rotates on the flag pole to provide accurate repeatable measurements. The tape measure is preferably attached to an axially rotating measuring tape attachment feature.

11 Claims, 9 Drawing Sheets

DISTANCE TO GOLF CUP MEASURING ACCESSORY

The present application claims the priority of U.S. Provisional Patent Application Ser. No. 61/568,580 filed Dec. 8, 2011, which application is incorporated in its entirety herein by reference.

BACKGROUND OF THE INVENTION

The present invention relates to determining the distance from a golf ball location to a hole and in particular to an accessory which attaches to a flag pole facilitating the measurement.

The game of golf is widely enjoyed around the world. Golf is regularly played in tournament, casual play, and practice. One common activity is precisely measuring the distance from a ball to the hole. Such measuring is done to determine the order of play, and in some events, to award prizes for the closest approach shot. Presently, the distance from the ball to the hole can only be measured by two players using a tape measure, using golf clubs, using the flag pole, or stepping off the distance, and when two balls are at similar distances from the hole, errors introduced into the measurements may produce a wrong result.

BRIEF SUMMARY OF THE INVENTION

The present invention addresses the above and other needs by providing a tape measure which is attached to an accessory attached to a flag pole residing in a golf course hole. The accessory includes a mouth openable to engage the flag pole. Once the mouth is closed, the pole resides in a throat surrounded by a plurality of rollers residing co-axial with the pole. The rollers allow the accessory to freely rotate on the flag pole, but include a non-slip outer surface to prevent the accessory from sliding on the pole. Tape is drawn from the tape measure attached to a measuring tape attachment feature to measure the distance to a golf ball, and the accessory freely rotates on the flag pole to provide accurate repeatable measurements. The tape measure is preferably attached to an axially rotating measuring tape attachment feature.

In accordance with one aspect of the invention, there is provided a distance to golf hole measuring accessory. The accessory includes: a handle having a hook at one end; a pivoting jaw cooperating with the hook in a closed position to create a mouth having a mouth centerline; at least three rollers carried by the hook and the jaw, the rollers co-axial with the mouth centerline and arranged in a circle and intersecting the mouth and configured to grasp a flag pole extending through the mouth when the jaw is in the closed position, the rollers having a non-slip outer surface and a measuring tape attachment feature on an end of the handle opposite to the jaw, the measuring tape attachment feature configured for attachment of a measuring tape end.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
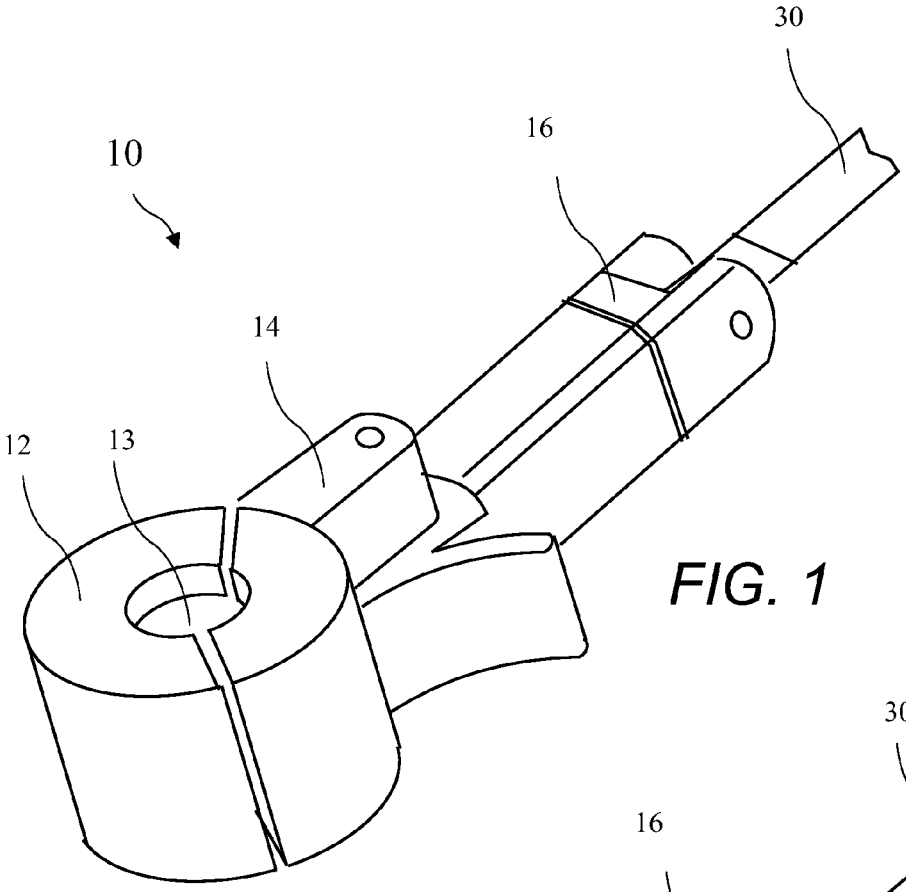
FIG. 1 is a perspective view of a distance to golf hole measuring accessory according to the present invention.
Figure 2:
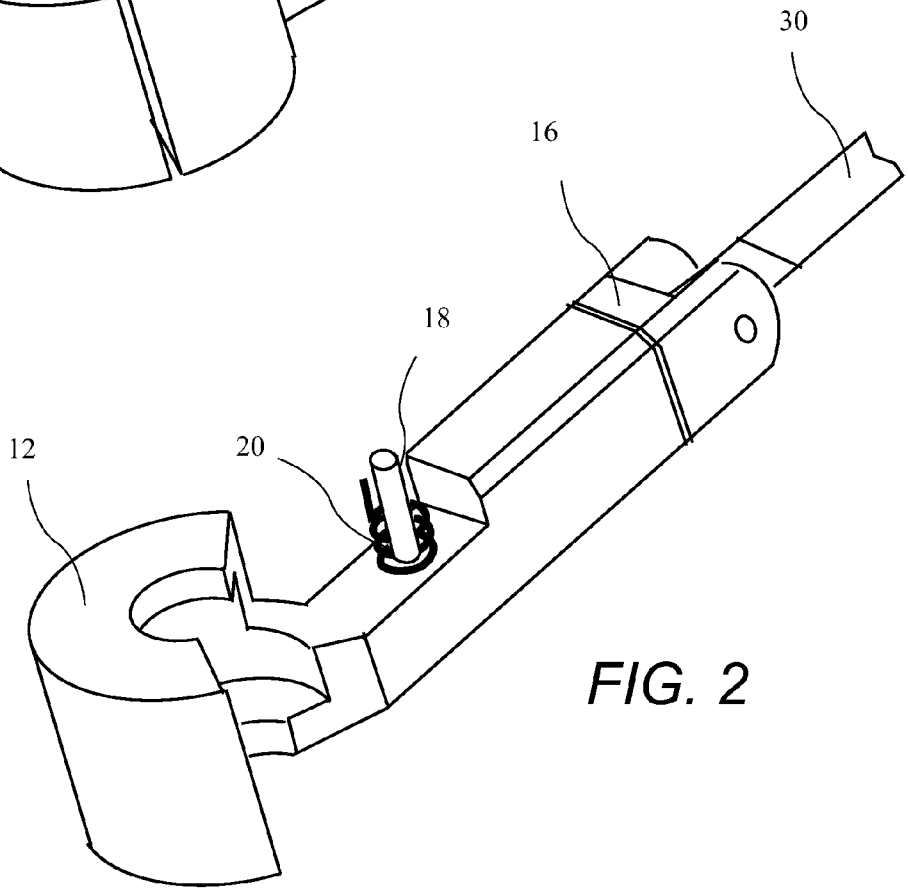
FIG. 2 is a perspective view of the distance to golf hole measuring accessory according to the present invention having a jaw removed to show jaw attachment features.

A perspective view of a distance to golf hole measuring accessory 10 according to the present invention is shown in FIG. 1 and a perspective view of the distance to golf hole measuring accessory 10 having a jaw 14 removed to show jaw attachment features is shown in FIG. 2. The accessory 10 includes a handle 12, a mouth 13 having a mouth centerline 13*a*, an opening jaw 15, and a measuring tape attachment feature 16. A measuring tape 30 is attachable to the measuring tape attachment feature 16 of the accessory 10. A shaft 18 provides pivoting attachment of the jaw 14, and a spring 20 biases the jaw 14 to a closed position. In another embodiment, a latch may be included to hold the jaw 14 in the closed position.

Figure 3:
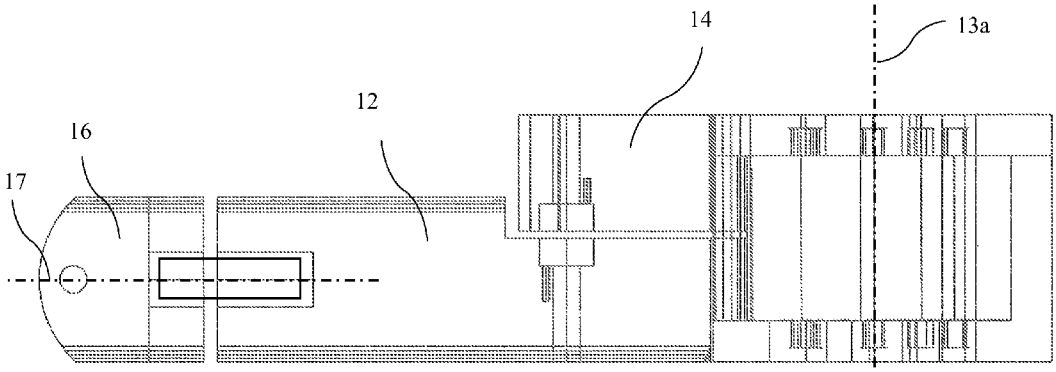
FIG. 3 is a side view of the distance to golf hole measuring accessory according to the present invention.
Figure 4A:
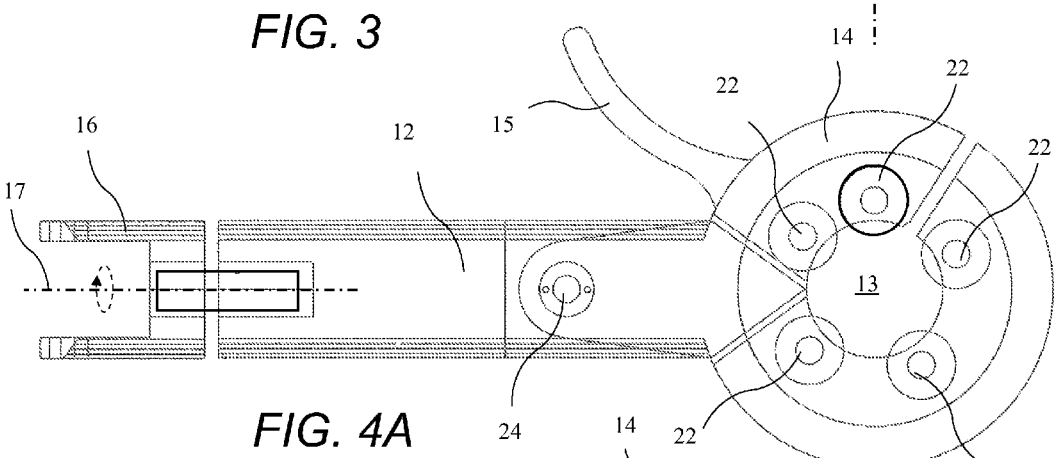
FIG. 4A is a top view of the distance to golf hole measuring accessory according to the present invention with a closed jaw.
Figure 4B:
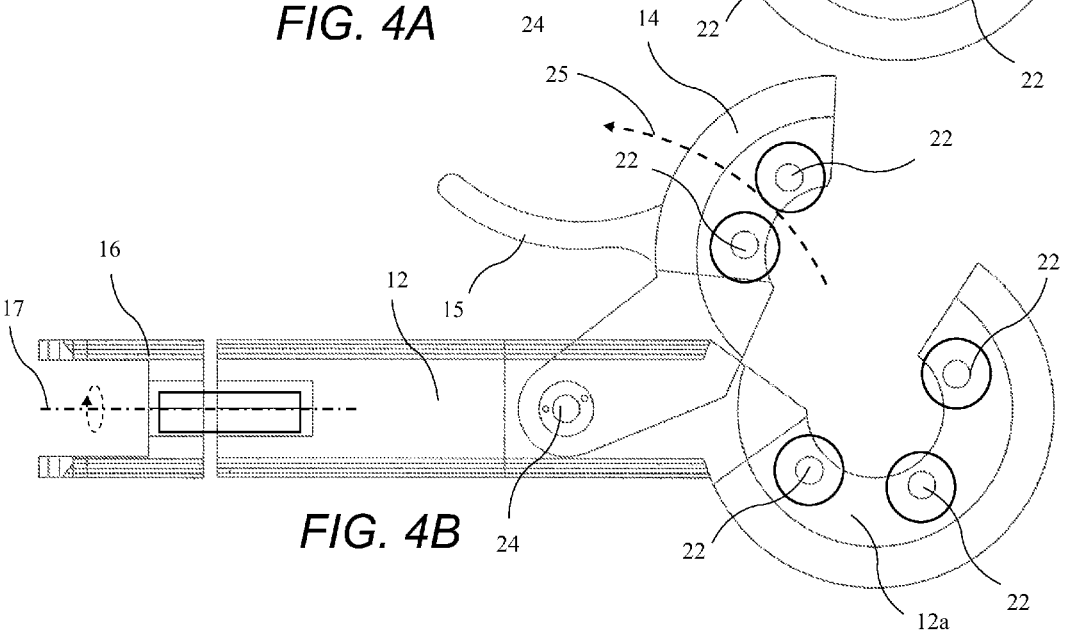
FIG. 4B is a top view of the distance to golf hole measuring accessory according to the present invention with an open jaw.

A side view of the accessory 10 is shown in FIG. 3, a top view of the accessory 10 with a closed jaw 14 is shown in FIG. 4A, and a top view of the accessory 10 with the jaw 14 open along arc 25 is shown in FIG. 4B. The jaw 14 cooperates with a hook portion 12*a* of the handle 12 to form a mouth 13. A plurality of rollers 22 carried by the hook 12*a* and the jaw 14 surround the mouth 13 and are pressed against the flag pole 36 (see FIG. 9) when the jaw 14 is closed. The rollers 22 are co-axial with a centerline 13*a* of the mouth 13 and intersect the mouth 13, and have a non-slip outer surface which resides against the flag pole and prevents or resists the accessory 10 sliding on the flag pole 36 when the jaw 14 is released. The rollers 22 further allow the accessory 10 to rotate freely on the flag pole 36 to obtain repeatable accurate distance measurements. The non-slip outer surface of the rollers may be, for example, nylon. The plurality of rollers 22 comprise at least three rollers 22 and preferably five rollers 22, and the rollers 22 are configured to grasp a flag pole 36 extending through the mouth 13 when the jaw 14 is in the closed position.

The jaw 14 has a trigger 15 allowing a golfer to easily open the jaw 14 to position the accessory 10 on the flag pole 36. A measuring tape attachment feature 16 is rotatably attached to the handle 12 and rotates about an axis 17 to allow the measuring tape 30 to find the shortest distance between the golf ball 32 (see FIG. 9) and the flag pole 36.

The measuring tape attachment feature 16 is rotatably attached to the handle 12 about a handle centerline 17.

Figure 5:
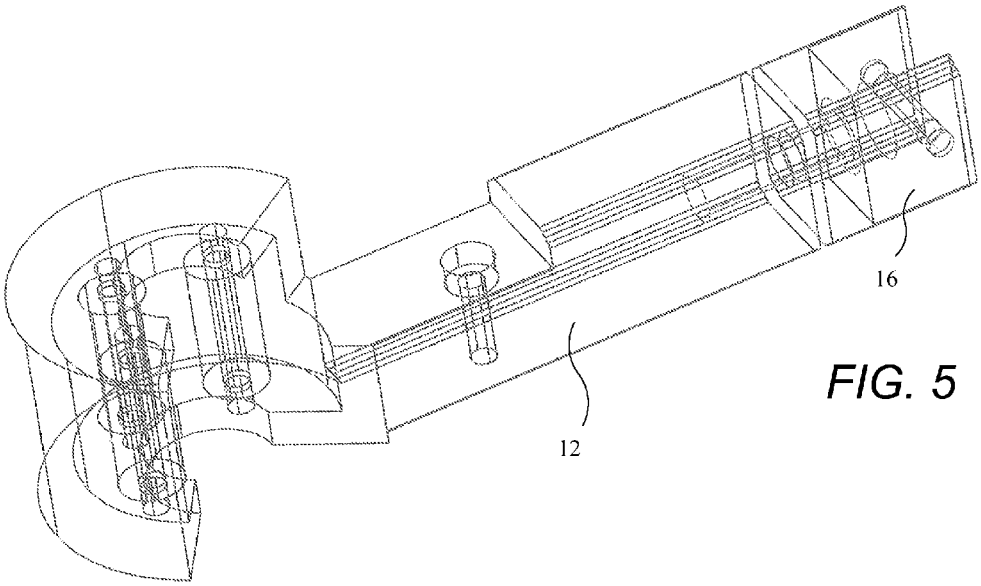
FIG. 5 shows a perspective view of the distance to golf hole measuring accessory according to the present invention with the jaw removed.
Figure 6:
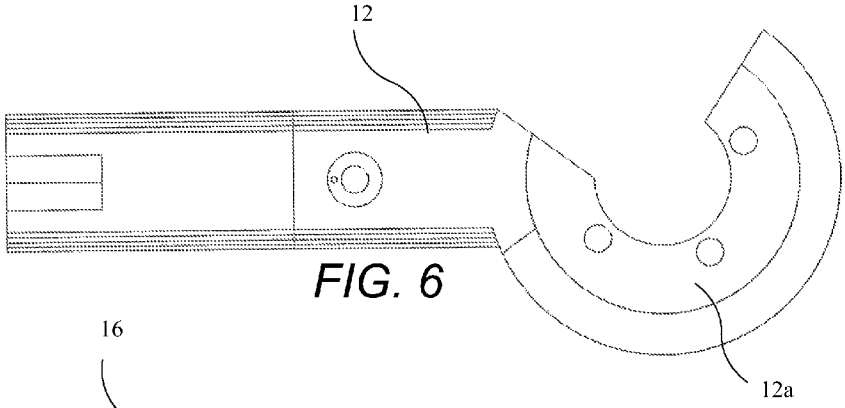
FIG. 6 shows a top view of the distance to golf hole measuring accessory according to the present invention with the jaw removed.

A perspective view of the accessory 10 with the jaw 14 removed is shown in FIG. 5 and a top view of the accessory 10 with the jaw 14 removed is shown in FIG. 6.

Figure 7:
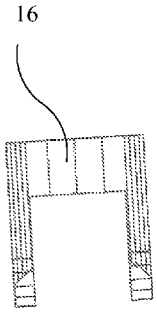
FIG. 7 shows a measuring tape attachment feature of the distance to golf hole measuring accessory according to the present invention.
Figure 8:
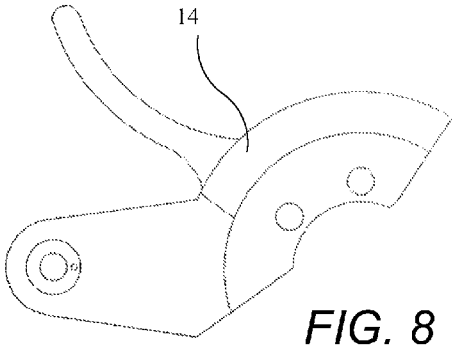
FIG. 8 shows the jaw of the distance to golf hole measuring accessory according to the present invention.

A top view of the measuring tape attachment feature is shown in FIG. 7 and a top view of the jaw 14 is shown in FIG. 8

Figure 9:
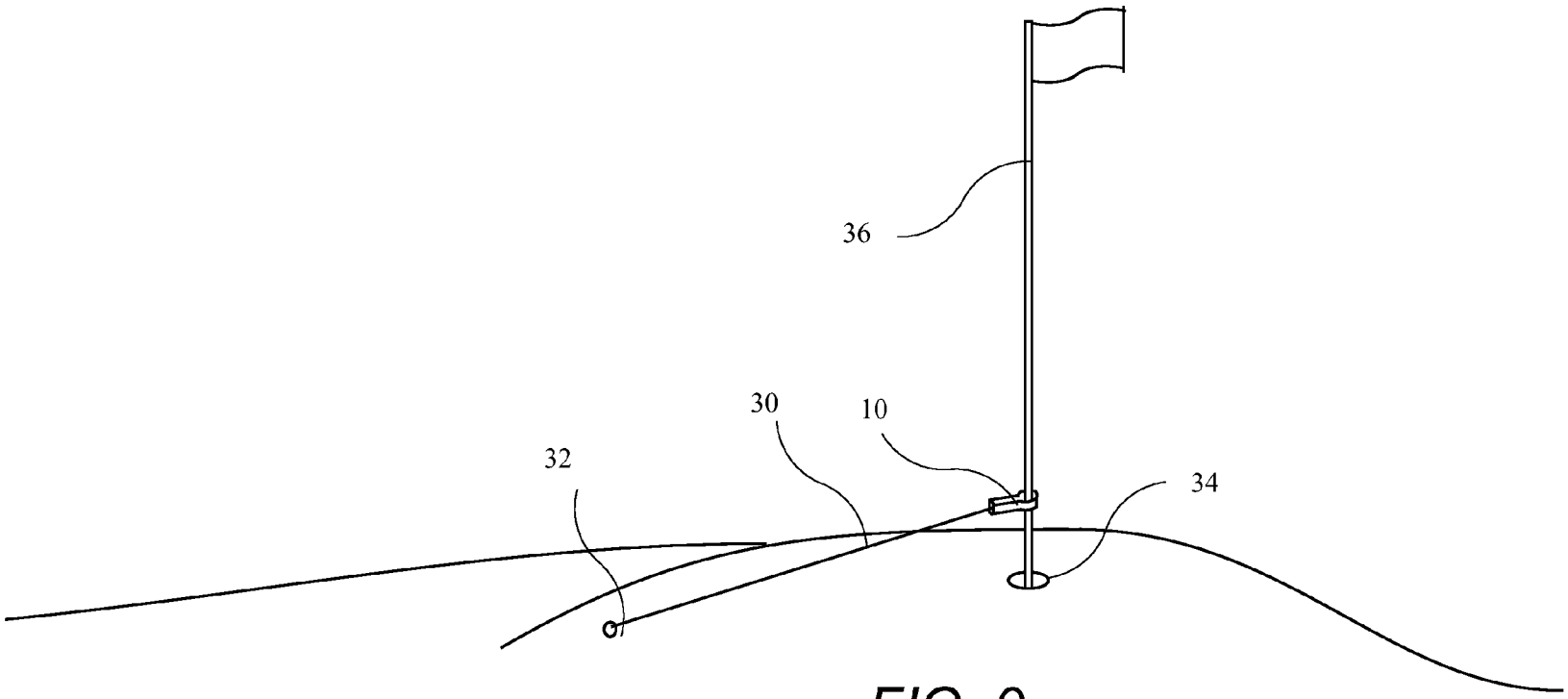
FIG. 9 shows the distance to golf hole measuring accessory according to the present invention being used to measure the distance from a golf ball to a hole.

The distance to golf hole measuring accessory 10 being used to measure the distance from a golf ball 32 to a hole 34 is shown in FIG. 9.

Figure 10A:
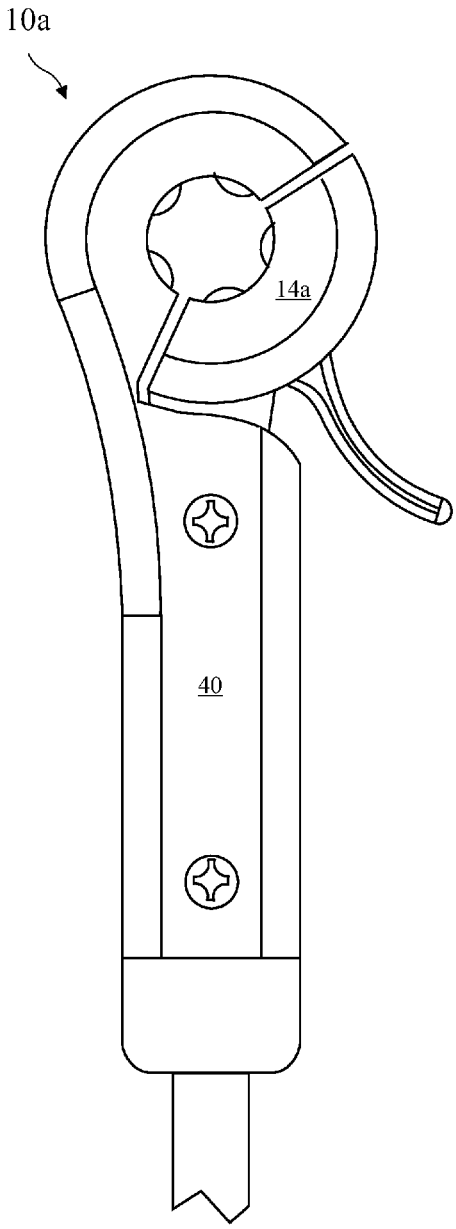
FIG. 10A shows a top view of a second embodiment of the distance to golf hole measuring accessory according to the present invention with a closed jaw.
Figure 10B:
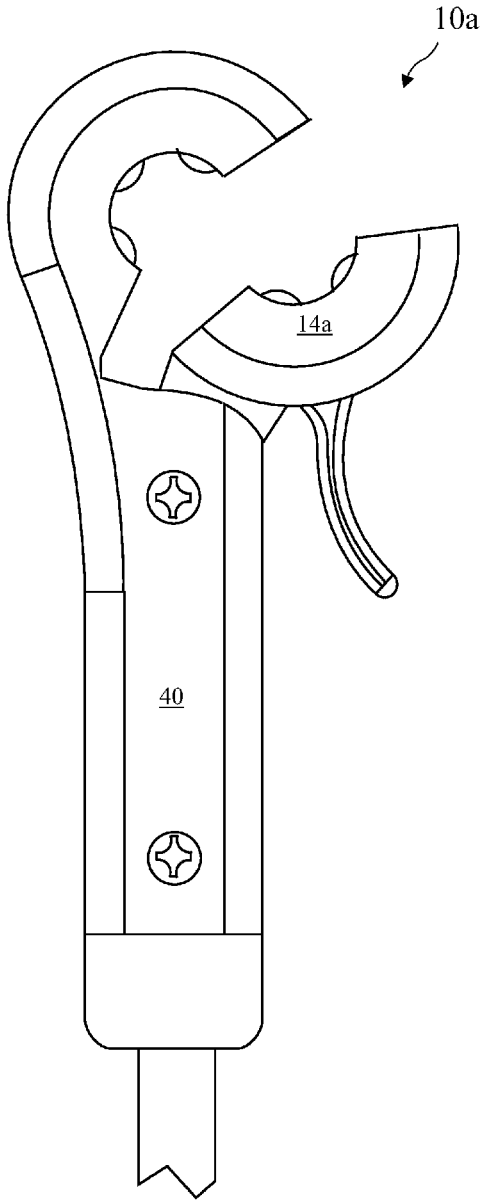
FIG. 10B shows a top view of a second embodiment of the distance to golf hole measuring accessory according to the present invention with an open jaw.

A top view of a second embodiment of the distance to golf hole measuring accessory 10*a* according to the present invention with a closed jaw 14*a* is shown in FIG. 10A and a top view of the distance to golf hole measuring accessory 10*a* with an open jaw 14*a* is shown in FIG. 10B. The distance to golf hole measuring accessory 10*a* is functionally similar to the distance to golf hole measuring accessory 10.

Figure 11A:
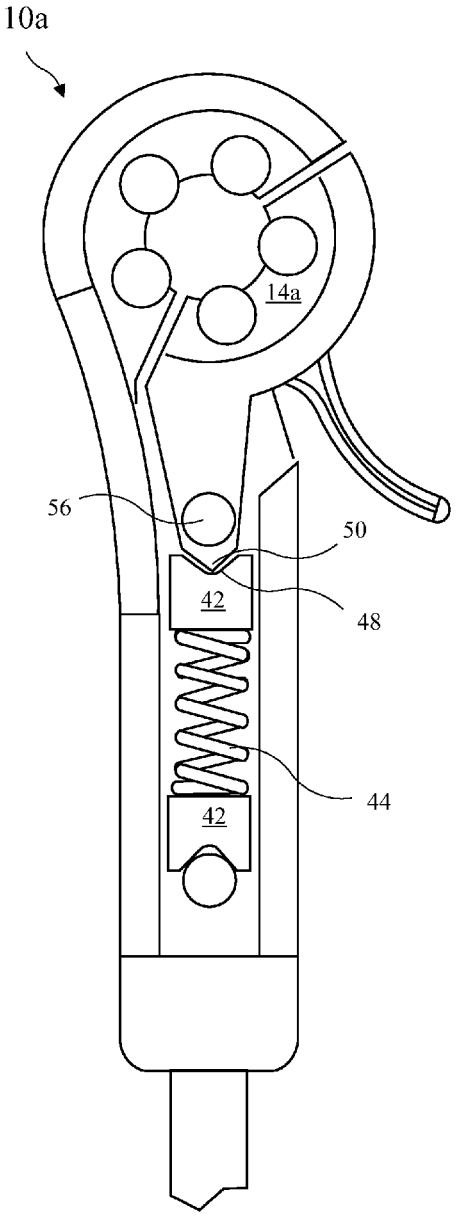
FIG. 11A shows a top view of the second embodiment of the distance to golf hole measuring accessory according to the present invention with a side plate removed and the closed jaw.
Figure 11B:
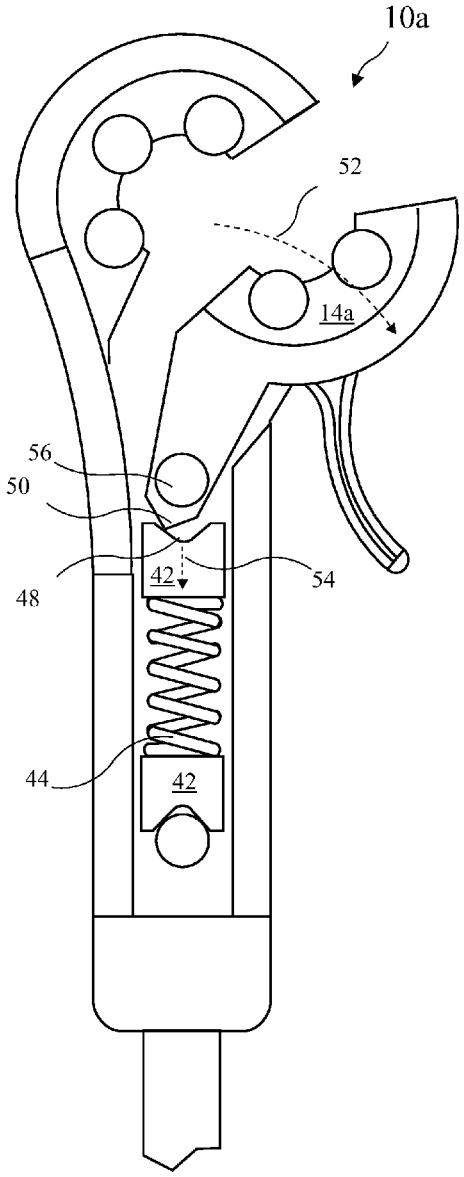
FIG. 11B shows a top view of the second embodiment of the distance to golf hole measuring accessory according to the present invention with the side plate removed and the open jaw.

A top view of the distance to golf hole measuring accessory 10*a* with a side plate 40 (see FIGS. 10A and 10B) removed and the closed jaw is shown in FIG. 11A and a top view of the distance to golf hole measuring accessory 10*a* with the side plate removed and the open jaw is shown in FIG. 11B. When the jaw 14*a* is closed, a narrowing end 50 is seated in a recess 48 in a seat 42, and a spring 44 applies force to the seat 42. The cooperation of the narrowing end 50 and the recess 48 holds the jaw 14*a* in the closed position. When the jaw 14*a* is pivoted about a jaw pivot 56 along arc 52, the narrowing end 50 rides up on a side wall of the recess 48 compressing the spring 44. When the jaw 14*a* is released, the spring 44 urges the jaw 14*a* back to the closed position on the flag pole 36.

Figure 12:
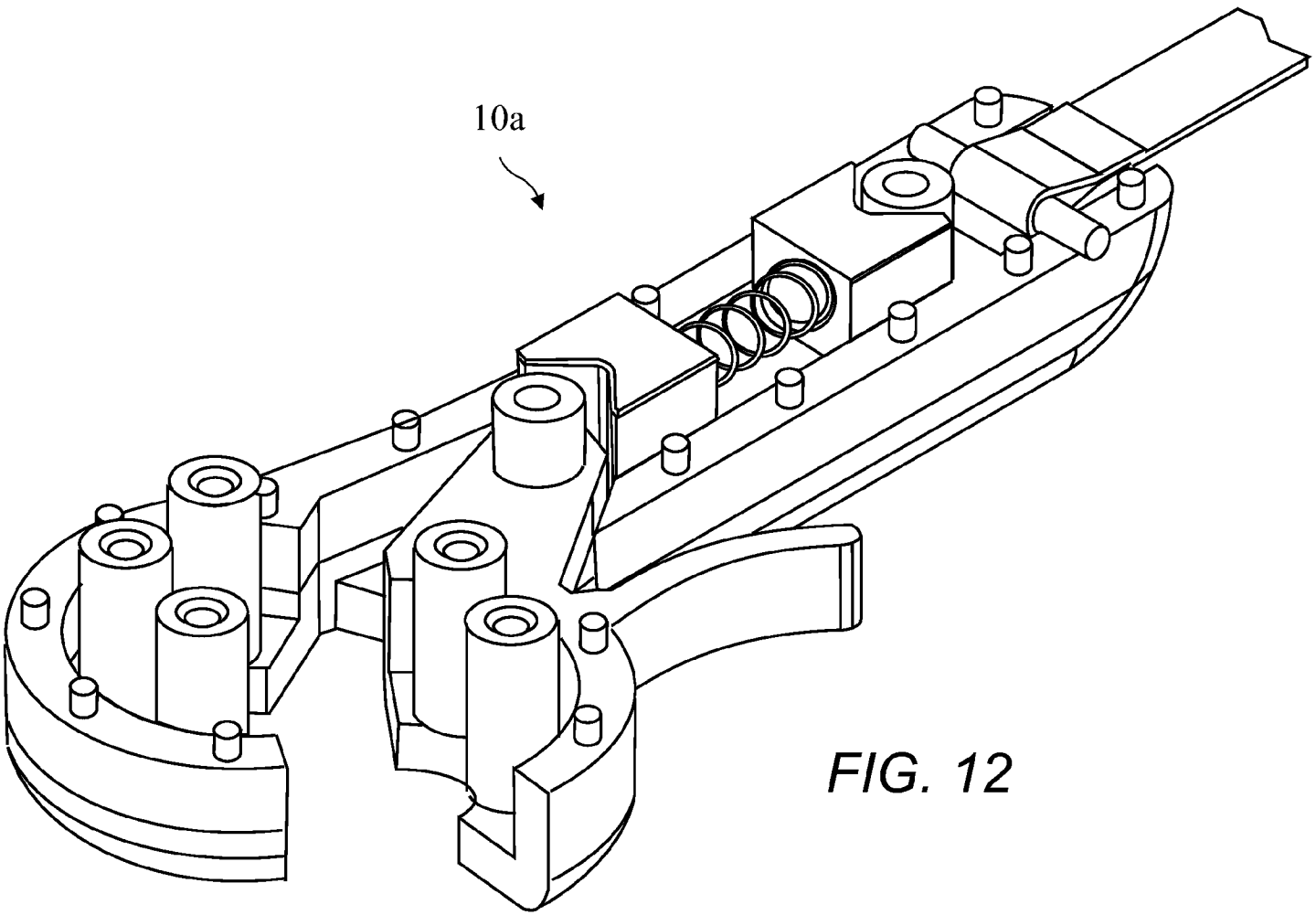
FIG. 12 shows a perspective view of a second embodiment of the distance to golf hole measuring accessory according to the present invention with the side plate removed and the open jaw.

FIG. 12 shows a perspective view of the distance to golf hole measuring accessory 10*a* with the side plate removed and the open jaw.

Figure 13A:
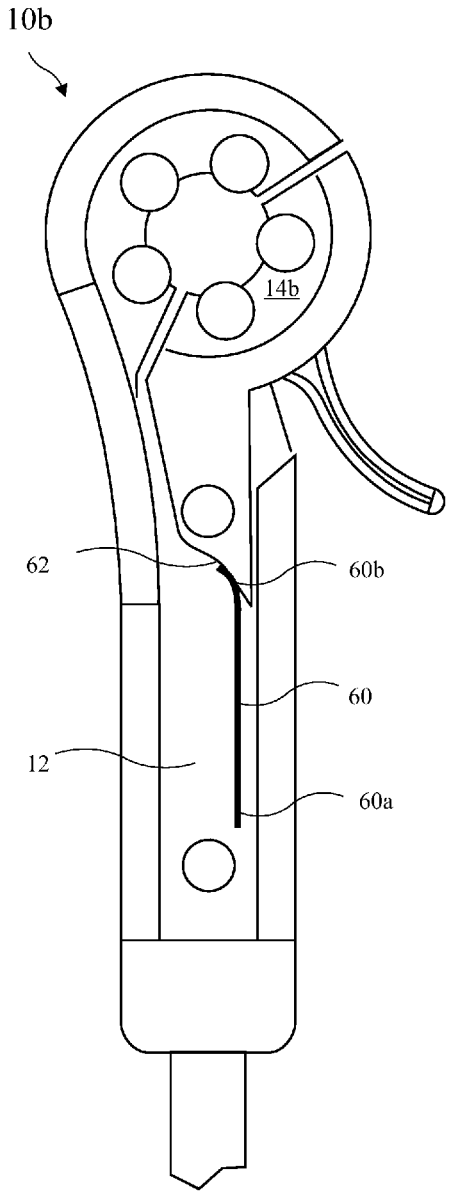
FIG. 13A shows a top view of a third embodiment of the distance to golf hole measuring accessory according to the present invention with the side plate removed and the closed jaw.
Figure 13B:
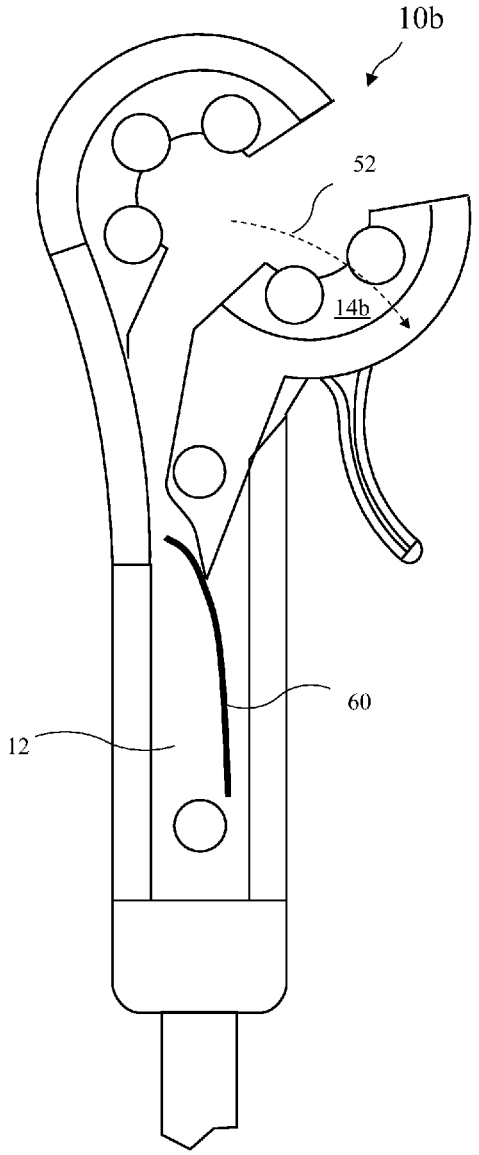
FIG. 13B shows a top view of the third embodiment of the distance to golf hole measuring accessory according to the present invention with the side plate removed and the open jaw.

A top view of a third embodiment of the distance to golf hole measuring accessory 10*b* according to the present invention with the side plate removed and the closed jaw is shown in FIG. 13A and a top view of the distance to golf hole measuring accessory 10*b* with the side plate removed and the open jaw is shown in FIG. 13B. The distance to golf hole measuring accessory 10*b* includes a flat spring 60 having a fixed end 60*a* fixed inside the handle 12 and a free end 60*b* opposite the fixed end and resting against a lever end 62 of a third jaw 14*b*. The flat spring 60 applies closing force to the jaw 14*b* to hold the jaw 14*b* on the flag pole 36.

Figure 14:
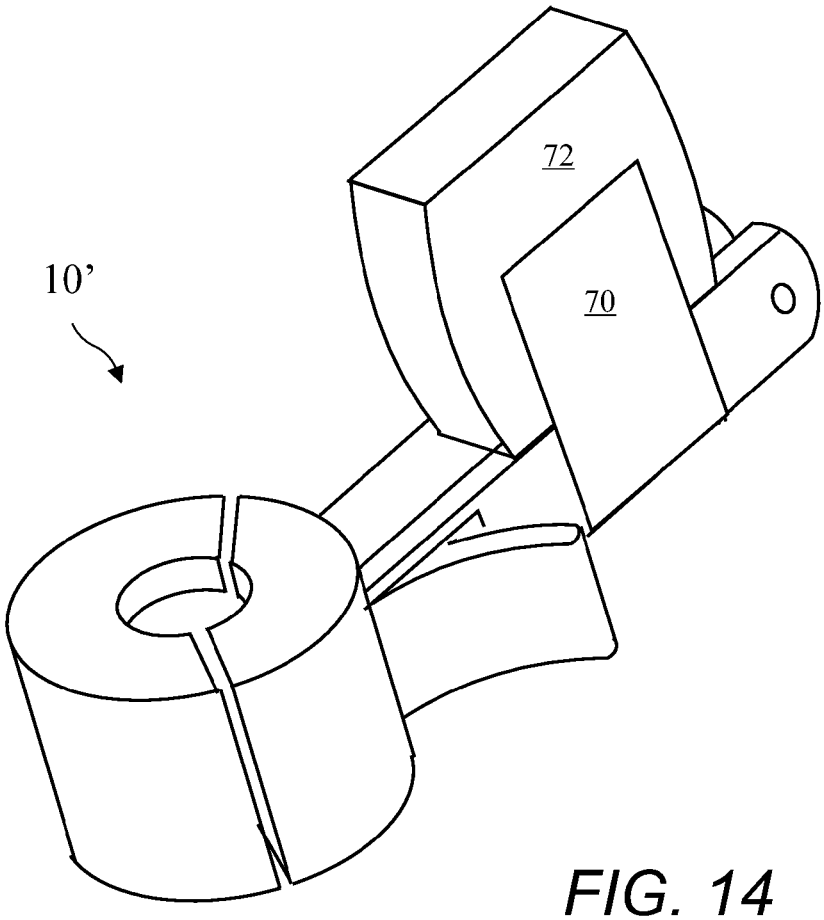
FIG. 14 shows the distance to golf hole measuring accessory having lips holding a measuring tape according to the present invention.

An distance to golf hole measuring accessory 10' having lips 70 for holding a measuring tape housing 72 is shown in FIG. 14. The distance to golf hole measuring accessory 10' may include any features of the distance to golf hole measuring accessories 10, 10*a*, or 10*b*.

While the invention herein disclosed has been described by means of specific embodiments and applications thereof, numerous modifications and variations could be made thereto by those skilled in the art without departing from the scope of the invention set forth in the claims.

We claim:

1. A distance to golf hole measuring accessory comprising:

a handle having a hook at one end;

a pivoting jaw cooperating with the hook in a closed position to create a mouth having a mouth centerline;

a coil spring residing parallel with the handle and inside the handle, the coil spring having a fixed end opposite the jaw and a sliding end applying force to the jaw to bias the jaw to remain in the closed position;

at least three rollers carried by a combination of the hook and the jaw, the rollers co-axial with the mouth centerline and arranged in a circle and intersecting the mouth and configured to grasp a flag pole extending through the mouth when the jaw is in the closed position; and a measuring tape attachment feature on an end of the handle opposite to the jaw, the measuring tape attachment feature configured for attachment of a measuring tape end.

2. The accessory of claim 1, wherein:

the jaw pivots about a jaw pivot and has a narrowing end opposite the mouth of the accessory;

the seat includes a recess facing the jaw and the narrowing end of the jaw is centered in the recess when the jaw is closed; and the narrowing end of the jaw rides up a wall of the recess when the jaw is open, depressing the seat and compressing the spring.

3. The accessory of claim 1, wherein at least three rollers comprises five rollers.

4. The accessory of claim 1, wherein the measuring tape attachment feature is rotatably attached to the handle about a handle centerline.

5. The accessory of claim 1, further configured to provide for attachment of a measuring tape housing to the accessory.

6. The accessory of claim 5, wherein the accessory includes opposing lips for attachment of the measuring tape housing to the accessory.

7. A distance to golf hole measuring accessory comprising:

a handle having a hook at one end;

a pivoting jaw cooperating with the hook in a closed position to create a mouth having a mouth centerline;

at least three rollers carried by a combination of the hook and the jaw, the rollers co-axial with the mouth centerline and arranged in a circle and intersecting the mouth and configured to grasp a flag pole extending through the mouth when the jaw is in the closed position, the rollers having a non-slip outer surface;

a coil spring residing parallel with the handle and inside the handle and having a fixed end opposite the jaw and a sliding end towards the jaw;

a seat moveable parallel with the handle and receiving force from the coil spring pushing the seat towards the jaw, the seat cooperating with the jaw to provide closing torque on the jaw; and a measuring tape attachment feature on an end of the handle opposite to the jaw, the measuring tape attachment feature configured for attachment of a measuring tape end.

8. A distance to golf hole measuring accessory comprising:

a handle having a hook at one end;

a jaw pivoting about a jaw pivot and cooperating with the hook in a closed position to create a mouth having a mouth centerline, the jaw having a narrowing end opposite the mouth of the accessory;

five rollers carried by a combination of the hook and the jaw, the rollers co-axial with the mouth centerline and arranged in a circle and intersecting the mouth and configured to grasp a flag pole extending through the mouth when the jaw is in the closed position, the rollers having a non-slip outer surface;

a coil spring residing parallel with the handle and inside the handle and having a fixed end opposite the jaw and a sliding end towards the jaw;

a seat moveable parallel with the handle and receiving force from the coil spring pushing the seat towards the jaw, the seat cooperating with the jaw to provide closing torque on the jaw;

the seat includes a recess residing against the narrowing end of the jaw, the narrowing end of the jaw centered in the recess when the jaw is closed and the narrowing end of the jaw rides up a wall of the recess when the jaw is open, depressing the seat and compressing the coil spring; and a measuring tape attachment feature on an end of the handle opposite to the jaw, the measuring tape attachment feature configured for attachment of a measuring tape end.

9. The accessory of claim 1, wherein the rollers having a non-slip outer surface.

10. The accessory of claim 1, further including a spring seat residing between the coil spring and the jaw, the spring seat receiving force from the coil spring and pushing against the jaw to bias the jaw to remain in the closed position.

11. The accessory of claim 10, wherein:

the jaw includes a narrowing end opposite the mouth of the accessory; and the spring seat includes a recess residing against the narrowing end of the jaw, the narrowing end of the jaw centered in the recess when the jaw is closed and the narrowing end of the jaw riding up a wall of the recess when the jaw is open, depressing the spring seat and compressing the coil spring.

* * * * *